US008628833B2

(12) United States Patent
Park et al.

(10) Patent No.: US 8,628,833 B2
(45) Date of Patent: Jan. 14, 2014

(54) STACKABLE INK-JET MEDIA

(75) Inventors: Chang Park, Sungnam-si (KR); Xulong Fu, San Diego, CA (US); Ronald J Selensky, Poway, CA (US); Eric L. Burch, San Diego, CA (US); Tao Chen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2082 days.

(21) Appl. No.: 11/789,191

(22) Filed: Apr. 23, 2007

(65) Prior Publication Data

US 2008/0257508 A1 Oct. 23, 2008

(51) Int. Cl.
*D21H 13/00* (2006.01)

(52) U.S. Cl.
USPC ..... 428/32.22; 347/104; 162/137

(58) Field of Classification Search
USPC ..... 428/32.22; 347/104; 162/137
See application file for complete search history.

(56) References Cited

U.S. PATENT DOCUMENTS

| | | | | |
|---|---|---|---|---|
| 5,472,757 | A * | 12/1995 | Ogawa et al. | 428/32.24 |
| 5,741,828 | A * | 4/1998 | Stoy et al. | 524/501 |
| 6,828,013 | B2 | 12/2004 | Ambroise et al. | |
| 6,863,933 | B2 | 3/2005 | Cramer et al. | |
| 6,872,444 | B2 | 3/2005 | McDonald et al. | |
| 6,893,592 | B2 | 5/2005 | Arrington et al. | |
| 7,112,621 | B2 | 9/2006 | Rohrbaugh et al. | |
| 2006/0068133 | A1 | 3/2006 | Khoultchaev et al. | |
| 2006/0078695 | A1 | 4/2006 | Sen et al. | |
| 2007/0031615 | A1 * | 2/2007 | Nair et al. | 428/32.38 |

FOREIGN PATENT DOCUMENTS

| | | | |
|---|---|---|---|
| EP | 1705028 | | 9/2006 |
| EP | 1878588 | | 1/2008 |
| JP | 2001-225547 | A | 8/2001 |
| KR | 2002-0012530 | A | 2/2002 |
| WO | WO2008118641 | | 10/2008 |

OTHER PUBLICATIONS

European Search Report dated May 13, 2011 for Application No./Patent No. 08746543.1-2304/2142378 PCT/US2008061141, Hewlett-Packard Development Company, L.P. (Applicant), Reference 200602961-4.

* cited by examiner

*Primary Examiner* — Gerard T. Higgins
*Assistant Examiner* — Sathavaram I Reddy

(57) ABSTRACT

A print medium for ink-jet printing comprises a base substrate, a micro-porous ink-receiving layer, and a backing layer. The base substrate can include raw base paper and a moisture barrier layer between the raw base paper and ink receiving layer. The ink-receiving layer can be a micro-porous type, and can be applied onto the moisture barrier at the first side of the base substrate and the backing layer can be applied to a second side of the base substrate. The backing layer can include an extruded coated polymer layer and can be configured to transport solvent vapor to the base substrate at the rate of at least 15 $g/m^2/24$ hr.

24 Claims, No Drawings

STACKABLE INK-JET MEDIA

BACKGROUND OF THE INVENTION

There are several reasons that ink-jet printing has become a popular way of recording images on various media surfaces, particularly paper. Some of these reasons include low printer noise, capability of high-speed recording, and multi-color recording. Additionally, these advantages can be obtained at a relatively low price to consumers. Though there has been great improvement in ink-jet printing, accompanying this improvement are increased demands by consumers in this area, e.g., higher speeds, higher resolution, full color image formation, increased ink stability, etc.

As new ink-jet inks and print engines are developed, there are several traditional characteristics to consider when evaluating the ink in conjunction with a printing surface or substrate. Such characteristics include edge acuity and optical density of the image on the surface, gloss, black to color bleed control, dry time of the ink on the substrate, adhesion to the substrate, lack of deviation in ink droplet placement, resistance of the ink after drying to water and other solvents, long term storage stability, and long term reliability without degradation. Additionally, ink-jet media substrates with micro-porous type coating can show increased blurriness, bleed, hue shift, or halo effect of printed images when stacked over a period of time due to destabilization of the inks of the printed image. Accordingly, investigations continue into developing printed photo media that has excellent image characteristics with improved printed image stability.

DETAILED DESCRIPTION OF THE PREFERRED EMBODIMENT(S)

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

In describing and claiming the present invention, the following terminology will be used in accordance with the definitions set forth below.

It is noted that, as used in this specification and the appended claims, the singular forms "a," "an," and "the" include plural referents unless the context clearly dictates otherwise. Thus, for example, reference to "a polymer" includes one or more of such polymers, and reference to "the print medium" includes reference to one or more print mediums.

As used herein, "liquid vehicle" or "ink vehicle" refers to the liquid fluid in which colorant is placed to form an ink. Ink vehicles are well known in the art, and a wide variety of ink vehicles may be used with the systems and methods of the present invention. Such vehicles may include a mixture of a variety of different agents, including solvents, co-solvents, buffers, biocides, sequestering agents, viscosity modifiers, surface-active agents (surfactants), water, etc.

As used herein, "media substrate" or "substrate" includes any substrate that can be used in the ink-jet printing arts including raw base paper and other papers, coated papers, art papers (e.g. water color paper), and the like.

As used herein, the term "curling" or "curl" refers to any distortion of a sheet of paper or other ink-jet recording medium due to differences in coating from one side to another or due to absorption of solvent vapor.

As used herein, the term "bleed" refers to any unwanted migration of ink after printing onto a desired substrate. Similarly, the term "color shifting" is meant to include any change in the coloration of a printed image due to bleed or other ink migration.

As used herein, the term "moisture vapor transmission rate" or "MVTR" refers to the amount of liquid that can be transported to the substrate through the backing layer in the form of vapor that volatilizes from the liquid. Generally, this term is used when referring to the ink solvents or vapors, e.g., water and organic solvents that can be transported from the printed front of a first media sheet to the unprinted back of a second media sheet upon stacking. The term "moisture" in this context should not be inferred to include only water, as solvents other than water can also form vapors which, if left in liquid form or trapped as a vapor in contact with a printed image for a sustained period of time, can reduce the image quality of a printed image. For the purposes of this application, this term is typically measured in $g/m^2/24$ hr.

The use of the term "solvent vapor" includes the vapors that form from any ink solvent found in a typical ink composition including, but not limited to, organic solvents and water.

As used herein, "plurality" refers to more than one. For example, a plurality of polymers refers to at least two polymers.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It has been recognized that it would be advantageous to develop a stackable micro-porous photographic ink-jet media sheets that can preserve the image quality of a printed media sheet when it is adjacently stacked with other media sheets by transporting solvent vapor away from the printed image after printing. Traditionally, high image quality ink-jet photographic printing materials include extruded polyethylene or polypropylene barrier layer on both side of the raw base paper to provide high gloss and a photo feel. However, stacking of traditional micro-porous ink-jet photographic printing materials right after image printing often results in color bleed, color shifting, and hazing due to the high amount of ink vehicles including solvents used in dye based ink-jet inks.

In contrast to traditional ink-jet photographic materials, the present invention provides ink-jet photographic printing media that serves as a high gloss or matt substrate while exhibiting improved stacking performance. More specifically, in accordance with this, the present invention is drawn to a print medium for ink-jet printing, comprising a base substrate which includes raw base paper, and a moisture barrier layer coated on the raw base paper; a micro-porous ink-receiving layer coated on the moisture barrier layer; and a polymer extruded backing layer extruded on the raw base paper. The polymer extruded backing layer can also be configured to transport solvent vapor to the base substrate at the rate of at least 15 $g/m^2/24$ hr.

In another embodiment, a method of preserving image quality when printing and stacking multiple printed images can comprise printing an image on a first print medium to form a first printed image, and stacking a second print medium on the first printing medium before the first printed image is dry. The first and second print mediums can each comprise a base substrate having a moisture barrier layer applied to a first side thereof, a micro-porous ink-receiving layer coated on the moisture barrier layer, and a polymer extruded backing layer which is applied to a second side of the base substrate. The polymer extruded backing layer can also be configured to transport solvent vapor to the base substrate at the rate of at least 15 $g/m^2/24$ hr.

In another embodiment, a method of manufacturing a stackable ink-jet print medium can comprise coating a base substrate with a moisture barrier layer on one side and extruding a polymer extruded backing layer on an opposing side; and coating a micro-porous ink-receiving layer onto the moisture barrier layer. The polymer extruded backing layer can be configured to transport solvent vapor to the base substrate at the rate of at least 15 $g/m^2/24$ hr.

It is noted that when discussing the print medium and the methods described herein, each of these specific discussions can be considered applicable to each of these embodiments, whether or not they are explicitly discussed in the context of that embodiment. Thus, for example, in discussing a backing layer, the backing layer discussion can be relevant to the print medium embodiments or the method embodiments, or vice versa.

Base Substrate

The ink-jet recording medium can be formed on a base substrate or support. The base substrate can be raw base paper and other paper, coated paper, fabric, art paper (e.g. water color paper), or the like, with a moisture barrier layer extruded only on one side of the raw base paper. Thus, though three layers are generally described herein, e.g., base substrate, ink-receiving layer, and backing layer, it is noted that any of these layers can be multi-layered of themselves. In one embodiment, any number of traditionally used paper fiber substrates may be used to form the raw base paper of the base substrate, such that the base substrate is able to receive, adsorb, or absorb solvent vapor at a rate of at least about 15 $g/m^2/24$ hour. More specifically, according to one embodiment, any number of raw base paper supports may be employed in the practice of the present method. Examples include, but are not limited to, any un-extruded paper that includes fibers, fillers, additives, etc., used to form an image supporting medium. More specifically, the substrate in the form of a raw base paper core may be made of any number of fiber types including, but not limited to, virgin hardwood fibers, virgin softwood fibers, recycled wood fibers, and the like.

In addition to the above-mentioned fibers, the raw base substrate may include a number of filler and additive materials. In one embodiment, the filler materials include, but are not limited to, calcium carbonate ($CaCO_3$), clay, kaolin, gypsum (hydrated calcium sulfate), titanium oxide ($TiO_2$), talc, alumina trihydrate, magnesium oxide (MgO), minerals, and/or synthetic and natural fillers. In one embodiment, if raw base paper or other fibrous base substrate is used as the base substrate, up to 40% by dry weight of the raw base paper core substrate may be made up of fillers. Inclusion of the above-mentioned fillers can reduce the overall cost of the raw base paper core substrate or other base substrate in a number of ways. On the other hand, the inclusion of white filler such as calcium carbonate may enhance the brightness, whiteness, and the quality of the resulting image supporting medium.

Other additives that may be included are sizing agents such as metal salts of fatty acids and/or fatty acids, alkyl ketene dimer emulsification products and/or epoxidized higher fatty acid amides; alkenyl or alkylsuccinic acid anhydride emulsification products and rosin derivatives; dry strengthening agents such as anionic, cationic or amphoteric polyacrylamides, polyvinyl alcohol, cationized starch and vegetable galactomannan; wet strengthening agents such as polyamine-polyamide epichlorohydrin resin; fixers such as water-soluble aluminum salts, aluminum chloride, and aluminum sulfate; pH adjustors such as sodium hydroxide, sodium carbonate and sulfuric acid; optical brightening agents; and coloring agents such as pigments, coloring dyes, and fluorescent brighteners. Additionally, the base substrate may include any number of retention aids, drainage aids, wet strength additives, de-foamers, biocides, dyes, and/or other wet-end additives.

In addition to the above-mentioned filler and additive materials, less than 20 wt % of the base substrate might be fine content, e.g., content having a particle size of 0.2-5 microns including chopped or fragmented small woody fiber pieces formed during the refining process of the pulp. In one embodiment, the fine content may range from about 4 wt % to 10 wt % (dry).

The moisture barrier layer on one side of the raw base substrate can be formed by an extrudable resin coating. In one embodiment, the top side of the raw base substrate can be extruded with a moisture barrier layer including, but not limited to, polyethylene, polyvinylbutyral, or polypropylene. The barrier layer can include any polyolefin or other known material that is useful for such a layer. The inclusion of a barrier layer on the substrate can provide a high gloss or matt surface and a photo feel to the ink-jet recording medium.

Ink-Receiving Layer

In accordance with embodiments of the present invention, one side of the base substrate can be coated with micro-porous ink-receiving layer, or alternatively, the micro-porous ink-receiving layer can comprise a plurality of layers, as is know in the art. The micro-porous ink-receiving layer can include an inorganic pigment.

In one embodiment, the inorganic pigment can include any number of inorganic oxide groups including, but not limited to silica and/or alumina, including those treated with silane coupling agents containing functional groups or other agents such as aluminum chlorohydrate (ACH). If silica is used, it can be selected from the following group of commercially available fumed silica: Cab-O-Sil LM-150, Cab-O-Sil M-5, Cab-O-Sil MS-55, Cab-O-Sil MS-75D, Cab-O-Sil H-5, Cab-O-Sil HS-5, Cab-O-Sil EH-5, Aerosil 150, Aerosil 200, Aerosil 300, Aerosil 350, and Aerosil 400.

In one embodiment, the substrate can be coated with fumed silica (modified or unmodified), and the silica may be in colloidal form. Specifically, in one embodiment, the aggregate size of the fumed silica can be between approximately 50 to 300 nm in size. More specifically, the fumed can be between approximately 100 to 250 nm in size. The Brunauer-Emmett-Teller (BET) surface area of the fumed silica can be between approximately 100 to 400 square meters per gram. More specifically, the fumed silica can have a BET surface area of 150 to 300 square meters per gram.

Alternatively, the substrate may be coated with an alumina (modified or unmodified). In one embodiment, the alumina coating can comprise pseudo-boehmite, which is aluminum oxide/hydroxide ($Al_2O_3.n\ H_2O$ where n is from 1 to 1.5). Additionally, in another embodiment, the substrate can be coated with an alumina that comprises rare earth-modified boehmite, such as those selected from lanthanum, ytterbium, cerium, neodymium, praseodymium, and mixtures thereof. Commercially available alumina particles can also be used, as are known in the art, including, but not limited to, Sasol Disperal HP10, boehmite, and Cabot SpectrAl 80 fumed alumina.

As mentioned above, the layer of fumed silica or alumina can be treated with silane coupling agents containing functional groups, ACH, and/or other functional or modifying materials. Additionally, the micro-porous ink-receiving layer may also include any number of surfactants, buffers, plasticizers, and other additives that are well known in the art.

During application, the micro-porous ink-receiving layer can be coated onto the substrate by any number of material dispensing machines including, but not limited to, a slot coater, a curtain coater, a cascade coater, a blade coater, a rod coater, a gravure coater, a Mylar rod coater, a wired coater, or the like.

Backing Layer

In accordance with embodiments of the present invention, the base substrate can also be extruded with a polymer extruded backing layer opposite the ink-receiving layer. In one embodiment, the polymer extruded backing layer can be applied on the bottom surface of the substrate. The backing layer may include any number of layers and polymers. The backing layer is configured to transport ink solvents, such as water, alcohol, pyrrolidone, and other high boiling water miscible solvents, to the base substrate (and in some embodiments, into the raw base paper).

Specifically, the polymers forming the backing layer can comprise any polymer that is capable of transporting ink solvents to the raw base substrate at a moisture vapor transmission rate (MVTR) of at least about 15 $g/m^2/24$ hr, or which is modified or applied so as to allow for transporting ink solvents to the substrate at a moisture vapor transmission rate (MVTR) of at least about 15 $g/m^2/24$ hr. In one embodiment, the MVTR can be at least 20 $g/m^2/24$ hr. In another embodiment, the MVTR can be at least 30 $g/m^2/24$ hr. Polymers that can be used include, but are not limited to, extrudable thermoplastic polyurethane, hydroxypropylcellulose, or poly-2-ethloxazoline. In one embodiment, the polymer can be a blend or copolymer. In another embodiment, the polymer can be polyurethane or polyurethane/polyolefin blend or copolymer. The polyurethane/polyolefin blend can comprise at least 5% polyolefin. In one embodiment, the blend can comprise at least 10% polyolefin. In another embodiment, the blend can comprise at least 20% polyolefin. The polyolefins used herein can include, but are not limited to, polypropylene (PP), high density polyethylene (HDPE), low density polyethylene (LDPE), and linear low density polyethylene (LLDPE). Additionally, the polyurethane/polyolefin blend can have about 5% to about 99.9% polyurethane. In one embodiment, the polyurethane can be a thermoplastic aliphatic polyurethane hydrogel. The backing layer may be extruded or co-extruded onto the bottom surface of the substrate by any number of extrusion coating methods.

Further, in one embodiment, the MVTR capabilities of the backing layer may be enhanced by forming a relatively rough surface finish (e.g., at least approximately 200 Sheffield units) on the exposed surface of the layer, or by forming holes or voids in the backing layer. A relatively rough surface finish can enhance the capillary action of the backing layer and can increase the MVTR property of the polymer coating. The relatively rough surface finish may be formed on the exposed surface of the backing layer by any number of methods including, but not limited to, embossing the backing layer or compressing a newly formed backing layer on a roller having a desired mating finish. Alternatively, in one embodiment, the polymer coating can comprise a vapor barrier polymer configured with holes which provide vapor communication between ambient air and a surface of the base substrate. In another embodiment, the polymer coating comprises a vapor barrier polymer with particulates dispersed therein. The particulates can be configured to provide interparticulate spaces which provide vapor communication between ambient air and a surface of the base substrate.

In accordance with embodiments of the present invention, the inclusion of the backing layer on the back side of the substrate can result in improved stacking qualities and curl resistance. More particularly, when a plurality of the present ink-jet print mediums receive printed images on the top ink-receiving layer and are subsequently stacked after printing on top of one another, the backing layer on the bottom surface of the substrate can transport solvent of the wet ink of the printed image from the ink-receiving layer through the backing layer. Consequently, bleed and color shifting of images on stacked media can be greatly reduced. Additionally, the backing layer can reduce the curling tendencies of the ink-jet print medium.

EXAMPLES

The following examples illustrate various aspects of the ink print medium in accordance with embodiments of the present invention. The following examples should not be considered as limitations of the invention, but merely teach how to make the best print media presently known.

Example 1

Preparation and Testing of Media Sheets with Breathable Backing Layers

Three different blends of polyurethane and low density polyethylene were prepared for use as backing layers. These backing layer compositions were compared against a non-breathable polymeric coating composition. Specifically, all four coatings were applied to the back of a base substrate material. The base substrate material can contain a raw base paper with a moisture barrier layer coated thereon. An ink-receiving layer was coated on a front surface of the base substrate. An ink-jet ink-produced image was printed on each of the ink-receiving layers, and the printed media was stacked front to back with 10 sheets of the same type of media (with the printed image on the bottom). The weight loss of the printed media is then calculated after stacking 1, 2, 4, and 6 hours; corresponding to how much solvent vapor was transmitted out of the first media sheet. The results were as follows:

TABLE 1

| Time | 90% thermoplastic aliphatic polyurethane hydrogel/ 10% LDPE | 30% thermoplastic aliphatic polyurethane hydrogel, 64% LDPE | 40% thermoplastic aliphatic polyurethane hydrogel, 52% LDPE | Non-breathable Photo paper with moisture barrier back layer |
|---|---|---|---|---|
| stacking hour | Solvent Vapor Evaporation (g) | Solvent Vapor Evaporation (g) | Solvent Vapor Evaporation (g) | Solvent Vapor Evaporation (g) |
| 1 | 0.1456 | 0.0565 | 0.0637 | 0.029 |
| 2 | 0.1492 | 0.0745 | 0.083 | 0.0316 |
| 4 | 0.1525 | 0.0745 | 0.087 | 0.0322 |
| 6 | 0.1524 | 0.126 | 0.0929 | 0.0412 |
| wt % solvent vapor Evaporated after 4 hour stacking | 97 wt % | 49 wt % | 54 wt % | 21 wt % |
| rate at first four hour of stacking ($g/m^2$/hour) | 2.46 | 1.20 | 1.41 | 0.52 |
| rate at ($g/m^2$/ 24 hour) | 59 | 29 | 34 | 12 |
| stacking performance (1 = worst, 5 = best) | 5 | 2 | 2.5 | 1 |

The data shows that the incorporation of a solvent vapor transporting polymer can increase the MVTR property of the print medium. Specifically, in this embodiment, the data shows that the higher the content of the polyurethane, the higher the MVTR of the backing layer. Similarly, incorporation of other solvent vapor transmitting polymers can provide improved MVTR properties and can therefore improve image quality and storability by allowing for transport of damaging solvent vapors that would otherwise be trapped on the surface of the printed image.

It is noted that though the non-breathable backing material provides poor results, acceptable results can be achieved by creating holes or voids in this backing material that allows the raw base substrate to be in vapor communication with the ambient surrounding air or environment. Holes can be created by perforations, or likewise, voids can be created by dispersing particulates in the polymeric matrix to provide the vapor transport rates as described herein.

Example 2

Preparation and Testing of Media Sheets with Breathable Backing Layers

Testing was conducted similarly as with respect to Example 1, where moisture vapor transport rates (MVTR) of various stacked polyurethanes were measured using Mocon 101K Water Vapor Transmission (38° C./90% Relative Humidity). The following table summarizes the results:

| Sample | Backing Layer Composition | Film thickness (millimeter) | MVTR ($g/m^2$/24 hour) | Performance |
|---|---|---|---|---|
| 1 | 90% thermoplastic aliphatic polyurethane hydrogel/ 10% LDPE | 1 | 4800 | Excellent |

-continued

| Sample | Backing Layer Composition | Film thickness (millimeter) | MVTR ($g/m^2$/24 hour) | Performance |
|---|---|---|---|---|
| 2 | thermoplastic polyurethane | 1 | 1100 | Excellent |
| 3 | 30% thermoplastic aliphatic polyurethane hydrogel/ 64% LDPE/ 6% additive | 2.5 | 90 | Some improvement over non-breathable backing |

The data shows that the addition of a solvent vapor transmitting polymer into the backing layer increases the MVTR and provides improved performance of the print medium upon printing and immediate stacking. The rates disclosed in this example appear to be elevated; however, the rates are dependent on temperature and humidity. This test was performed at fairly elevated temperatures and humidity giving rise to elevated MVTRs. Even so, the test indicates the connection between solvent vapor transmitting polymers and increased MVTRs, along with better overall print medium performance. Again, it is noted that the addition of holes or voids to a backing coating that underperforms can also provide a means for transporting solvent vapors from a printed ink-receiving layer through a backing layer.

Of course, it is to be understood that the above-described formulations and arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A print medium for ink jet printing, comprising:

a) a base substrate, including:

i) raw base paper, and ii) a moisture barrier layer coated on the raw base paper;

b) a micro-porous ink-receiving layer coated on the moisture barrier layer; and c) a polymer extruded backing layer extruded on the raw base paper, wherein the polymer extruded backing layer is configured to transport solvent vapor to the base substrate at a rate of at least 15 $g/m^2/24$ hr.

2. The print medium of claim 1, wherein the moisture barrier layer comprises a polyolefin barrier layer.

3. The print medium of claim 1, wherein the polymer extruded backing layer comprises a vapor barrier polymer configured with holes which provide vapor communication between ambient air and a surface of the base substrate.

4. The print medium of claim 1, wherein the polymer extruded backing layer comprises a vapor barrier polymer with particulates dispersed therein, said particulates configured to provide interparticulate spaces which provide vapor communication between ambient air and a surface of the base substrate.

5. The print medium of claim 1, wherein the polymer extruded backing layer transports solvent vapor at a rate of at least 20 $g/m^2/24$ hr.

6. The print medium of claim 1, wherein the polymer extruded backing layer includes a thermoplastic polyurethane/polyolefin blend or copolymer.

7. The print medium of claim 1, wherein the polymer extruded backing layer includes a thermoplastic polyurethane that is present in the blend from about 5% to about 99.9%.

8. The print medium of claim 1, wherein the polymer extruded backing layer includes a thermoplastic aliphatic polyurethane hydrogel.

9. A method of preserving image quality when printing and stacking multiple printed images, comprising:

a) printing an image on a first print medium to form a first printed image;

b) stacking a second print medium on the first printing medium before the first printed image is dry, wherein the first and second print mediums each comprise a base substrate including a raw base paper having a moisture barrier layer coated on a first side of the raw base paper, a micro-porous ink-receiving layer coated on the moisture barrier layer, and a polymer extruded backing layer which is applied to a second side of the raw base paper, said polymer extruded backing layer configured to transport solvent vapor to the base substrate at the rate of at least 15 $g/m^2/24$ hr.

10. The method of claim 9, wherein the moisture barrier layer comprises a polyolefin barrier layer.

11. The method of claim 9, wherein the polymer extruded backing layer comprises a vapor barrier polymer configured with holes which provides vapor communication between ambient air and a surface of the base substrate.

12. The method of claim 9, wherein the polymer extruded backing layer comprises a vapor barrier polymer with particulates dispersed therein, said particulates configured to provide interparticulate spaces which provide vapor communication between ambient air and a surface of the base substrate.

13. The method of claim 9, wherein the polymer extruded backing layer transports solvent vapor at a rate of at least 20 $g/m^2/24$ hr.

14. The method of claim 9, wherein the polymer extruded backing layer includes a thermoplastic polyurethane/polyolefin blend or copolymer.

15. The method of claim 9, wherein the polymer extruded backing layer includes a thermoplastic polyurethane that is present in the blend from about 5% to about 99.9%.

16. The method of claim 9, wherein the polymer extruded backing layer includes a thermoplastic aliphatic polyurethane hydrogel.

17. A method of manufacturing a stackable ink-jet print medium, comprising:

a) coating a raw base paper with a moisture barrier layer on one side to form a base substrate;

b) coating a micro-porous ink-receiving layer onto the moisture barrier layer; and c) extruding a polymer extruded backing layer on an opposing side;

wherein the polymer extruded backing layer is configured to transport solvent vapor to the base substrate at the rate of at least 15 $g/m^2/24$ hr.

18. The method of claim 17, wherein the moisture barrier layer comprises a polyolefin barrier layer.

19. The method of claim 17, wherein the polymer extruded backing layer comprises a vapor barrier polymer configured with holes which provides vapor communication between ambient air and a surface of the base substrate.

20. The method of claim 17, wherein the polymer extruded backing layer comprises a vapor barrier polymer with particulates dispersed therein, said particulates configured to provide interparticulate spaces which provide vapor communication between ambient air and a surface of the base substrate.

21. The method of claim 17, wherein the polymer extruded backing layer transports solvent vapor at a rate of at least 20 $g/m^2/24$ hr.

22. The method of claim 17, wherein the polymer extruded backing layer includes a thermoplastic polyurethane/polyolefin blend or copolymer.

23. The method of claim 17, wherein the polymer extruded backing layer includes a thermoplastic polyurethane that is present in the blend from about 5% to about 99.9%.

24. The method of claim 17, wherein the polymer extruded backing layer includes a thermoplastic aliphatic polyurethane hydrogel.

* * * * *

UNITED STATES PATENT AND TRADEMARK OFFICE

CERTIFICATE OF CORRECTION

PATENT NO. : 8,628,833 B2
APPLICATION NO. : 11/789191
DATED : January 14, 2014
INVENTOR(S) : Chang Park et al.

It is certified that error appears in the above-identified patent and that said Letters Patent is hereby corrected as shown below:

In the Claims

In column 9, line 2, in Claim 1, delete “ink jet” and insert -- ink-jet --, therefor.

Signed and Sealed this
Twentieth Day of May, 2014

Michelle K. Lee

Michelle K. Lee
*Deputy Director of the United States Patent and Trademark Office*